US005257737A

United States Patent [19]

Vestergaard

[11] Patent Number: 5,257,737

[45] Date of Patent: Nov. 2, 1993

[54] THERMOSTATIC EXPANSION VALVE FOR REFRIGERATING PLANTS

[75] Inventor: Anders Vestergaard, Sydals, Denmark

[73] Assignee: Danfoss A/S, Nordborg, Denmark

[21] Appl. No.: 805,030

[22] Filed: Dec. 11, 1991

[51] Int. Cl.[5] ..... G05D 23/12

[52] U.S. Cl. ..... 236/92 B; 62/225

[58] Field of Search ..... 62/225; 236/92 B; 251/285, 61.4, 84

[56] References Cited

U.S. PATENT DOCUMENTS

| | | | |
|---|---|---|---|
| 2,484,156 | 10/1949 | Dube et al. | 236/92 B X |
| 3,119,449 | 1/1964 | Price | 251/285 X |
| 3,478,774 | 11/1969 | Noakes et al. | 62/225 X |
| 3,731,498 | 5/1973 | Beatembough et al. | 62/225 |
| 4,342,421 | 8/1982 | Widdowson | 62/225 X |
| 4,432,492 | 2/1984 | Kunz | 62/225 X |

*Primary Examiner*—William E. Tapolcai
*Attorney, Agent, or Firm*—Wayne B. Easton

[57] ABSTRACT

The valve has a valve seat disposed in the fluid flow path between the inlet and outlet and a closure member adjustable relative to the valve seat by an actuating device. A valve actuating shaft which is connected to the closure member includes an adjustment element for selectively varying the effective length of the shaft. Further, a stop member is provided in the valve housing for adjustment in the direction of movement of the closure member to block the closing movement of the closure member toward the valve seat to prevent the closure member engaging the valve seat. This ensures that there is a permanently open flow path with an adjustable throttle resistance by which a minimum flow is maintained.

4 Claims, 2 Drawing Sheets

THERMOSTATIC EXPANSION VALVE FOR REFRIGERATING PLANTS

Figure 1:
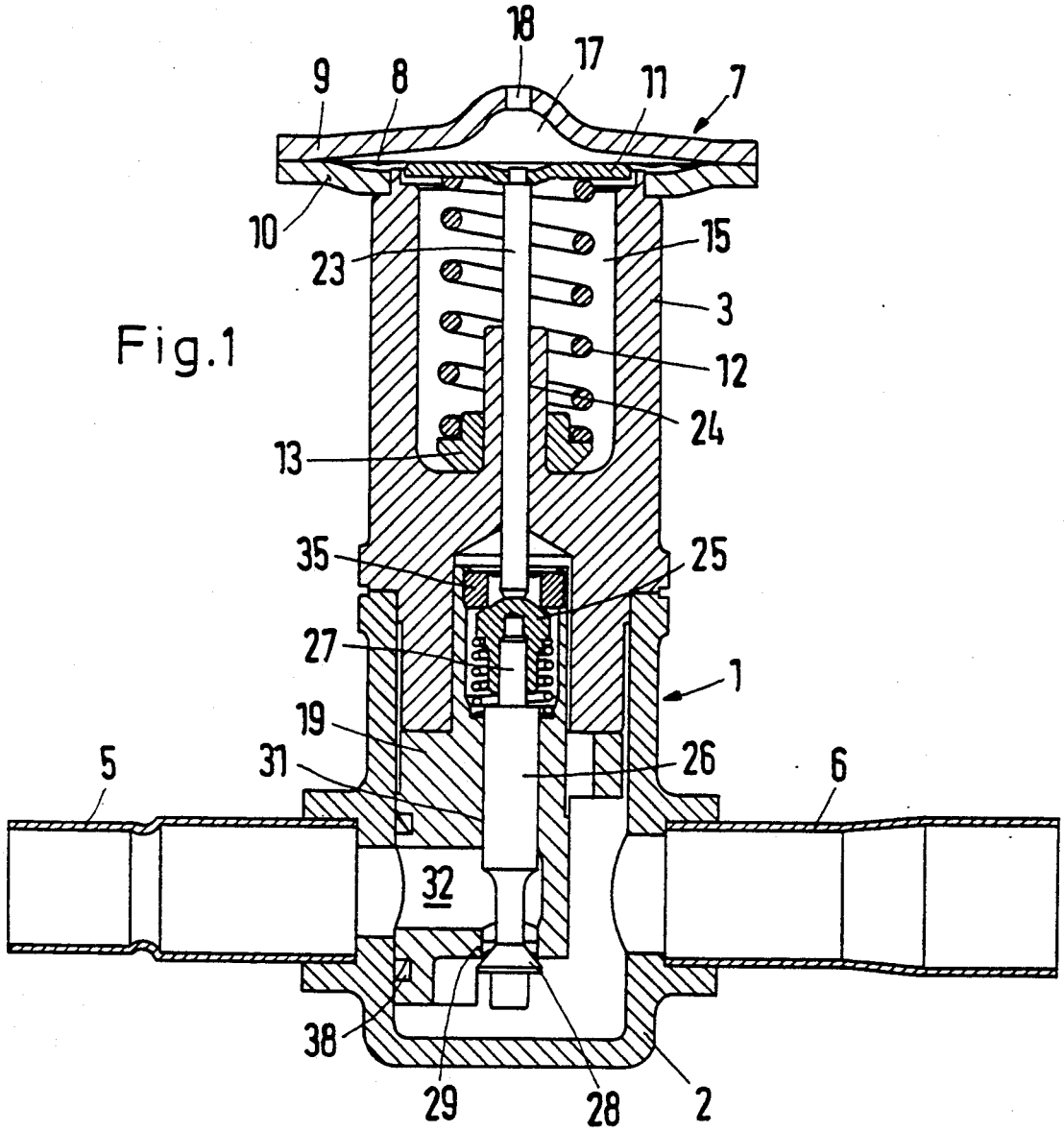

The invention relates to a thermostatic expansion valve for refrigerating plants, in which a closure member that co-operates with a seat is adjustable as required by an actuating device, and a permanently open flow path with an adjustable throttle resistance is provided for maintaining a minimum flow.

In a known expansion valve of this kind (DE-PS 904 775), a secondary path is connected in parallel with the main path leading through the valve seat, the secondary path being provided with an adjustable throttle screw. The minimum flow is adjusted in accordance with the refrigerating plant such that the desired lowest evaporation temperature can be maintained. Because the flow is never completely interrupted, control across the entire range of the evaporation temperature is good. Compared with a fixed bore (U.S. Pat. No. 3,367,130, FIG. 2), the adjusting screw provides an opportunity for one and the same expansion valve to be used for refrigerating plants of different size. The arrangement and construction of the secondary path, however, require additional expenditure.

Expansion valves are also already known (U.S. Pat. No. 3,367,130, FIG. 4; U.S. Pat. No. 3,252,297), in which the secondary path is in the form of an annular slot concentric with the valve axis between the bore in a screw-in bushing and a bolt of smaller diameter joined to the closure member or valve seat. Although in this case there are no problems associated with space, it is possible to effect an adaptation only by exchanging the screw bushes.

The invention is based on the problem of providing a thermostatic expansion valve of the kind described in the introduction, in which the space requirements are less and the production costs for the permanently open flow path with an adjustable throttle resistance are lower.

This problem is solved according to the invention by a stop member restricting the closing movement of the closure member before it engages the seat, the stop member being adjustable in the direction of movement of the closure member.

The stop member determines the smallest opening cross-section of the valve, which forms the permanently open flow path. No additional space and no additional manufacturing operation are required for this. The adjustable stop member, which is simple to manufacture and can also be mounted without problems associated with space, serves for adjustment purposes.

It is especially advantageous for the stop member to be threaded. Unlike a stop member that is pressed into the correct adjusting position, the threaded arrangement also allows a subsequent adjustment.

In a preferred form of embodiment, provision is made for the stop member to be formed by a ring concentric with the valve axis, which co-operates with a shoulder that is carried by a valve-actuating shaft joined to the closure member. The shoulder and the stop member can be positioned anywhere along the valve-actuating shaft and close to the valve axis, so that the space required can be kept to a minimum.

It is especially preferable for the valve-actuating shaft to be divided, and for an adjusting element joined to the part facing the closure member to be inserted at the separation point. This adjusting element enables the effective length of the valve-actuating shaft to be changed and thus the valve of the actuating device to be adapted.

In particular, the adjusting element can be screwed onto the part of the valve-actuating shaft facing the closure member. Here too, a subsequent adjustment is accordingly also possible.

It is especially advantageous for the adjusting element to have the shoulder. By combining the functions there is a further saving of space.

In a further development of the invention, provision is made for an insert for receiving the part of the valve-actuating shaft facing the closure member to have a stepped longitudinal bore which at one end has the valve seat and at the other end is enlarged to receive a closure spring and the annular stop member as well as an inlet-side transverse bore between them. All the essential parts can thus be pre-assembled in use, and the entire assembly then inserted in a housing.

Figure 2:
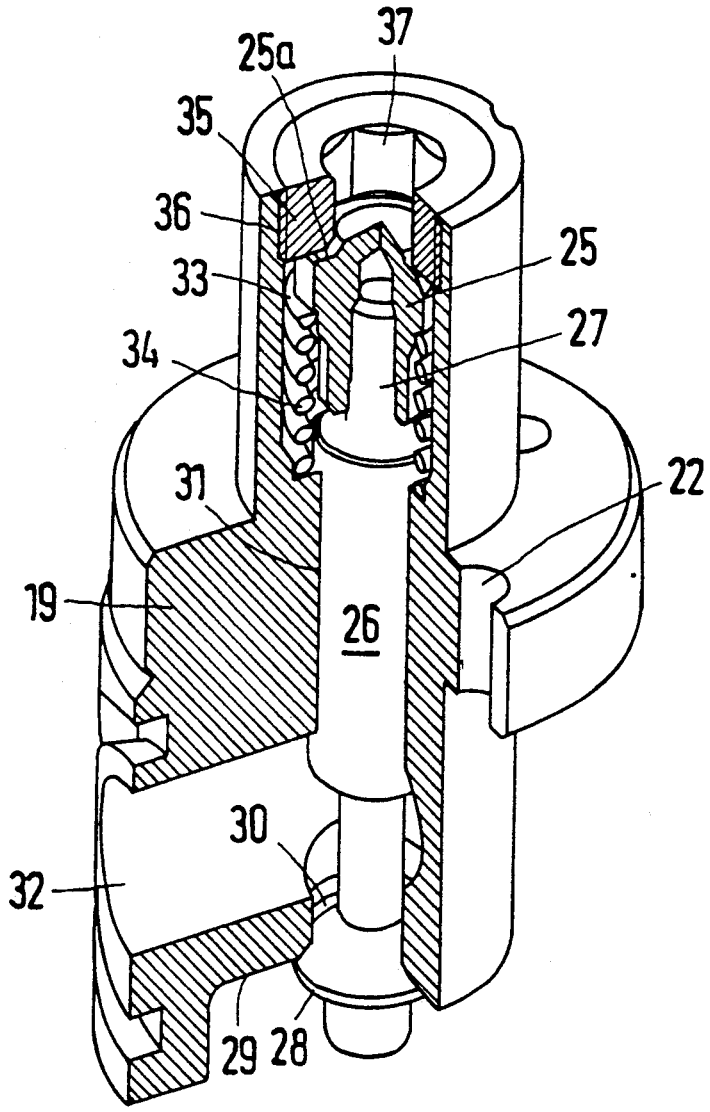

The invention is explained in detail below with reference to a preferred embodiment illustrated in the drawing, in which FIG. 1 shows an expansion valve according to the invention, partially cut away, and FIG. 2 shows an insert, partially cut away.

A housing 1 consists of a housing lower part 2 and a housing upper part 3. The lower part of the housing carries an inlet nozzle 5 and on the opposite side an outlet nozzle 6. As an actuating means 7, the upper part 3 of the housing carries a diaphragm shell with a diaphragm 8 which is clamped at its edge between the upper part 9 of the shell and the lower part 10 of the shell and is supported in the middle by a plate 11. The housing upper part 3 furthermore encloses a biasing spring 12 which at one end bears against the plate 11 and at the other end bears against an abutment 13 held in the housing upper part 3. The space 15 beneath the diaphragm 8 can be under the pressure of a section of the conduit of the refrigerating plant, especially the suction line. The space 17 above the diaphragm 8 can be under the vapour pressure of a temperature sensor, especially a liquid-vapour temperature sensor arranged at the end of the suction line, and is provided for that purpose with a connecting bore 18.

In the housing 1 there is an insert 19, illustrated to a larger scale in FIG. 2. An upper part 23, fixed to the plate 11, of a valve-actuating shaft 24 acts via the intermediary of a threaded adjusting element 25 on the lower part 26 of the valve-actuating shaft 24. This lower part 26 has at its upper end a bolt 27, onto which the adjusting element 25 can be screwed, and at its lower end a closure member 28 which together with a valve seat 29 on the insert 19 forms a valve throttle gap 30. The insert 19 has a longitudinal bore 31 passing through the valve seat 29, into which bore, part way along its length, an inlet-side transverse bore 32 opens. The longitudinal bore 31 has at its upper end an enlargement 33 which serves to accommodate a closure spring 34, which at the bottom bears against the insert 19 and at the top bears against the adjusting element 25.

The enlargement 33 also receives a stop member 35 in the form of a ring concentric with the valve axis, the stop member being joined by way of a thread 36 to the insert 19 and having a hexagon socket 37 for adjustment purposes. A shoulder **25*a* on the adjusting element 25 co-operates with this ring. Further details, such as the annular grooves 38 on the lower part of the insert 19** for the insertion of sealing rings are merely indicated.

As FIG. 2 shows, the insert can be pre-assembled with the lower part 26 of the valve-actuating shaft 24, the adjusting element 25, the closure spring 34 and the stop member 35. The insert 19 is then joined to the upper housing part 3, for example by means of screws, which engage through bores 22. The entire assembly is then inserted in the lower housing part 2.

There are two possible adjustments for this expansion valve. Using the adjusting screw 25 the total length of the valve-actuating shaft 24 can be altered, and it is thus possible to ensure that the travel of the closure member 28 and the travel of the diaphragm are consistent with one another. Secondly, the stop member 35 can be used to set the smallest open position of the valve throttle gap 30, which in its turn determines the minimum flow that must be permanently maintained. The adjustment is effected prior to installation of the insert 19 in the upper housing part 3: this involves merely setting the desired value positions predetermined for a specific application purpose. In cases in which the permanently opened flow path is not desired, the same valve parts can be used, but the stop member 35 is omitted or moved into an ineffective position.

The illustrated construction can be modified in many respects without departing from the basic concept of the invention. For example, the two housing parts may each have a flange, the flanges being joined to one another by screws or the like. The screw thread between the adjusting element 25 and the bolt 27 and between the bolt 35 and the insert 19 can be replaced by a force fit, the adjustment into a desired position being effected by applying an increased pressure force.

I claim:

1. A thermostatic expansion valve for refrigerating plants, comprising, a valve housing having an inlet and an outlet, first means in the housing for fluidly connecting the housing inlet to the housing outlet and having a valve seat opening to the inlet and the outlet, closure means having a longitudinal axis of movement between a full flow open position and a closed position blocking fluid flow through the valve seat, said closure means being mounted in the housing for movement in a longitudinal direction, adjustable stop means mounted in the housing and being adjustable in the longitudinal direction relative to the housing for restricting the movement of the closure means toward the valve seat to maintain a minimum permanently opened flow path through the valve seat from the inlet to the outlet, means comprising a closure member and a valve actuating shaft joined to the closure member to extend toward the stop means and having a shoulder for abutting against the stop means to limit the movement of the closure member toward the valve seat and that the stop means comprises a ring concentric with said axis for cooperating with said shoulder, said valve actuating shaft being divided into a first and a second part and having a separation point, the first part being more closely adjacent to the valve seat than the second part and an adjusting element connected to the first part for selectively adjusting the effective length of the valve actuating shaft, said first means comprising an insert mounted in the housing and having the valve seat and a stepped longitudinally extending bore that has one end opening to the valve seat and an enlarged longitudinally opposite end, a closure spring in the bore enlarged opposite end for resiliently urging the closure means toward its closed position and an inlet transverse bore opening to the housing inlet and to the bore one end, the stop member being annular and located in the longitudinal bore.

2. An expansion valve according to claim 1, characterized in that the second part has an end longitudinally opposite the first part and diaphragm means mounted to the housing and to the second part end in fixed relationship thereto for moving the closure means, the spring acting against the adjusting member to resiliently urge closure means toward the valve seat.

3. An expansion valve according to claim 2, characterized in that the closure means includes a closure member for cooperating with the valve seat to control fluid flow through the valve seat, the first part being joined to the closure member and that the adjusting element is threadedly mounted to the first part.

4. An expansion valve according to claim 3, characterized in that the adjusting means has said shoulder.

* * * * *